United States Patent [19]

Brooks

[11] Patent Number: 4,587,997

[45] Date of Patent: May 13, 1986

[54] WOVEN SHADE SCREEN

[75] Inventor: James S. Brooks, Tuscaloosa, Ala.

[73] Assignee: Phifer Wire Products, Inc., Tuscaloosa, Ala.

[21] Appl. No.: 703,309

[22] Filed: Feb. 20, 1985

[51] Int. Cl.[4] ..... D03D 15/00

[52] U.S. Cl. ..... 139/420 R

[58] Field of Search ..... 139/420 A, 420 C, 420 R, 139/426 R; 428/257, 258, 259, 152

[56] References Cited

U.S. PATENT DOCUMENTS

| | | | |
|---|---|---|---|
| 3,417,794 | 12/1968 | Lynch | 139/420 C |
| 4,002,188 | 1/1977 | Hanks | 139/420 R |
| 4,197,345 | 4/1980 | Worrall | 139/420 R |
| 4,303,695 | 12/1981 | McCann | 428/152 |
| 4,434,200 | 2/1984 | Fash | 428/257 |

*Primary Examiner*—Henry S. Jaudon
*Assistant Examiner*—Joseph S. Machuga
*Attorney, Agent, or Firm*—Patrick F. Henry

[57] ABSTRACT

A woven screen fabric for blocking out undesirable light and glare but admitting air and desirable light comprises 1000 denier high-tenacity polyester core fill yarn coated with a plasticized poly-vinyl chloride plastic coating to a finished diameter of 0.0250±0.0010 inch. The plastic is extruded onto the core yarn and is pigmented and heat, light and UV stabilized and the fill mesh may be 16±1 ends per linear inch. An ECG 150 fiberglass core warp yarn is coated with a poly-vinyl chloride plastisol coating to a finished diameter of 0.0115±0.0010 inch. The plastisol is drip-coated onto the core warp yarn and is pigmented, heat, light and UV stabilized to produce a strong, flexible, weather resistant and abrasion resistant coating. The warp mesh may be 63±2 ends per lineal inch. The fabric may be woven with individual warp yarn members arranged in an over and under relationship with the fill yarn members to provide a group of six individual strand members.

12 Claims, 3 Drawing Figures

WOVEN SHADE SCREEN

The field of the invention is woven screen fabrics such as those used for insect screens in windows and doors and and also to block out undesirable light and glare but at the same time to emit as much air as possible and some desirable light.

In the Hanks U.S. Pat. No. 4,002,188, (hereinafter Hanks patent) which is assigned to Phifer Wire Products, Inc., Tuscaloosa, Ala. 35403, there is disclosed a woven fabric shade screen comprising substantially even spaced elongated strands in one direction, such as the fill direction, and groups of more closely spaced strands woven so that the two outside strands alternate and so forth. The weave of the present fabric is very similar to the weave and structural arrangement of that fabric disclosed in the Hanks patent. While the fabric of the Hanks patent is very satisfactory, the present fabric is an improvement over the fabric disclosed in the Hanks patent, especially from the standpoint of maintenance and appearance while still permitting natural light to come through, reduced glare, reduced fading, and allow good visibility. The present fabric utilizes a different fill yarn comprising in one preferred embodiment a 1000 denier high-tenacity polyester core yarn coated with a plasticized poly-vinyl chloride plastic coating to a finished diameter of 0.0250±0.0010 inch. The plastic is extruded onto the core yarn and is pigmented and heat, light, and UV stabilized to produce strong, flexible, weather-resistant and abrasion resistant coating. Accordingly, the fill mesh may be 16±1 ends per linear inch. The warp yarn consists of a ECG 150 fiberglass core yarn coated with a poly-vinyl chloride plastisol coating to a finished diameter of 0.0115±0.0010 inch. The plastisol is drip-coated onto the core yarn and is pigmented and heat, light, and UV stabilized to produce a strong, flexible, weather resistant and abrasion resistant coating. The warp mesh may be 63±2 ends per lineal inch. Further data will be furnished hereinafter concerning the source of the yarns on the open market.

A primary object of this invention is to provide a woven fabric shade screen which has improved characteristics over that disclosed in the Hanks U.S. Pat. No. 4,002,188 and other known shade fabrics.

A further object of this invention resides in the disclosure of a woven shade fabric which offers visibility and openness with a texture and design different from other shade fabrics. The shade fabric will also admit wanted light and air, but will block out unwanted sunrays and glare. In addition, it will reduce fading of interior furnishings.

Other objects and advantages of the present invention will be readily understood and appreciated upon reading the following detailed description of the preferred embodiment taken in conjunction with the accompanying drawings, wherein.

DESCRIPTION OF A PREFERRED EMBODIMENT

Figure 2:
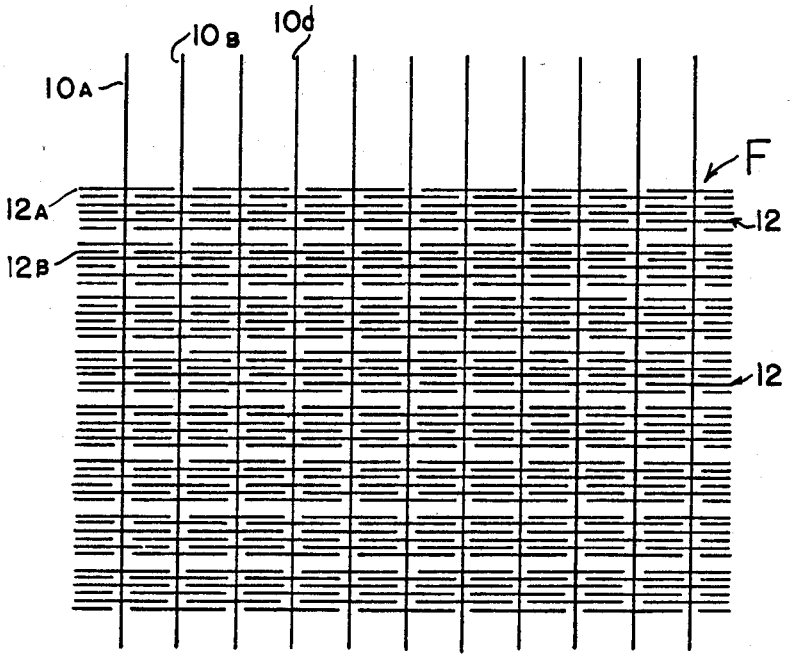
FIG. 2 is a diagrammatic view of a larger section of woven screen made in accordance with the present invention.
Figure 3:
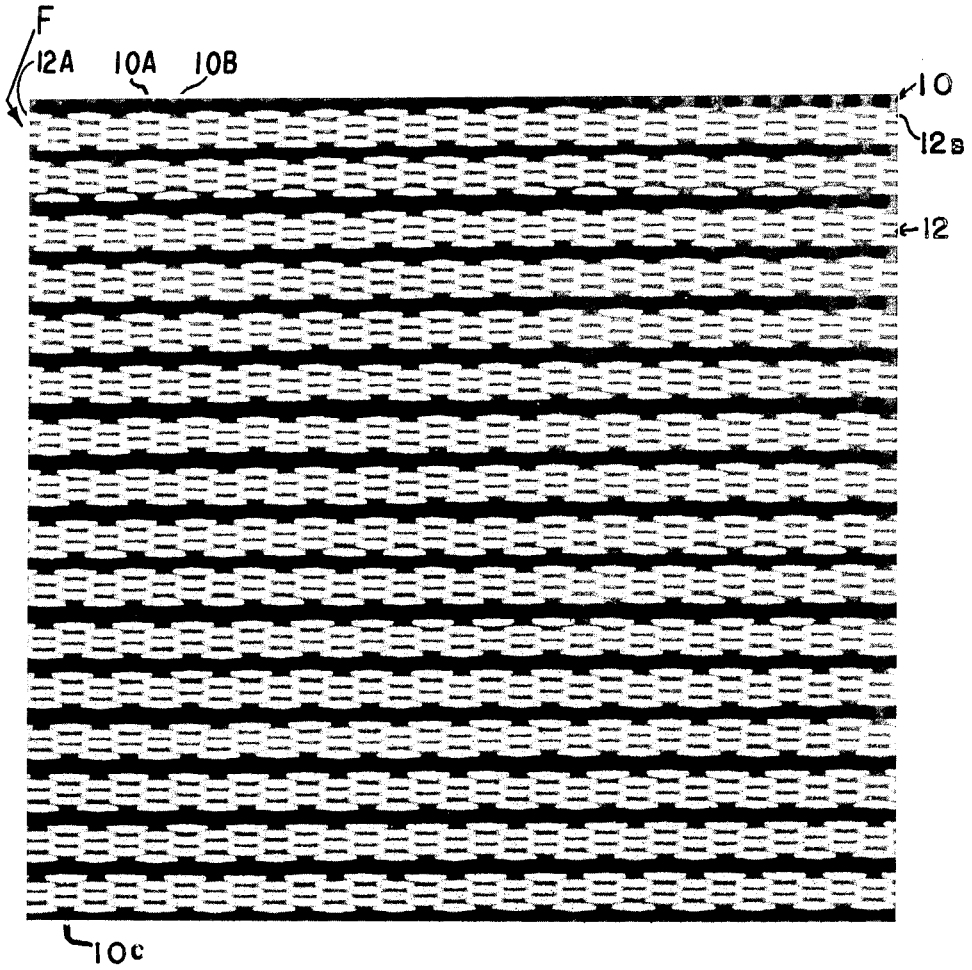
FIG. 3 is a photographic reproduction of an actual sample of fabric made in accordance with the present invention.

In the woven fabric F all the members 10 are strands of yarn in the fill direction of weaving and all the members 12 are strands of yarn in the warp direction. Accordingly, the members 10 are designated in the drawings as strands 10*a*, 10*b*, and 10*c*, etc. in the fill direction and the members 12 are designated as strands 12*a* thru 12*f* in the warp direction. In the diagrammatic view of FIG. 2, the warp strands 12, etc. are broken at the intersection with the strands 10*a*, etc. in the fill direction to represent crossing under rather than crossing over as shown in full lines. Thus, the present fabric F is a typical example of a continuously woven fabric F having the strands 10*a*, etc. in the fill direction and the strands 12*a*, etc. in the warp direction and the fabric F resembles very closely from a weaving standpoint the fabric disclosed and described in the Hanks U.S. Pat. No. 4,002,188 discussed above. The mesh may be a 63×16 configuration. The fabric F is woven from a combination of strands of two basic fibers—fiberglass and polyester. The fiberglass core yarn is in the strands 12 in the warp direction whereas the polyester is in the core yarns 10 in the fill direction. The combination of the different size yarns and materials creates a unique texture. The openness of the fabric allow good visibility and has the unique characteristic of a finished edge whenever the fabric is cut.

The fabric F may be woven on a SULZER projective loom.

The warp yarn members 12 in the form of the individual yarn strands 12*a*, 12*b*, etc. are made from a basic fiberglass core yarn which is vinyl coated, pigmented, heat, light and UV stabilized. The warp mesh may be 63±2 ends per lineal inch. The basic fiberglass core yarn may be obtained from the following sources according to the accompanying identification:

Designation: ECG 150 1/0 1.OZ.

Specification: ASTM D 578-81; *Standard Specification for Glass Fiber Yarns*

Vendors:

PPG Industries, Inc.,
Fiberglass Textile Products,
One PPG Place,
Pittsburgh, Pa. 15272
Product Identification No: 1118480010
Owens-Corning Fiberglass Corporation,
717 5th Avenue,
New York, N.Y. 10022
Production Identification No: 59K53606

The vinyl-coated fiberglass yarn which is, as mentioned previously, the fill yarn 12 and individual strands 12*a*, 12*b*, etc. may be obtained from the following sources:

Designation: 11 mil vinyl coated fiberglass yarn

Specification: ASTM D 3374-80; *Standard Specification for Vinyl Coated Glass Yarns*

Vendors:

Phifer Wire Products, Inc., 4400 Kauloosa Avenue,
Tuscaloosa, Ala. 35401
Engineered Yarns, Inc.,
372 Main Street,
Coventry, R.I. 02816,
Production Identification No. 11 MIL————17

The polyester core yarn which is used as the fill strand members 10 in the individual warp 10*a*, 10*b*, etc. is made from a basic polyester core yarn (e.g. 1000 denier) that has been extruded with a plasticized polyvinyl chloride plastic coating and pigmented, heat, light and UV stabilized to provide a fill mesh, for example, of 16±1 ends per linear inch; and which has the following designation and specification and may be obtained from the following vendors:

Designation: 1000 Denier High Tenacity Polyester Yarn

Specification: ASTM D 3219-79; *Standard Tolerances for Industrial Filament Yarns, Tire Cords, and Tire Cord Fabrics Made From Man-Made Organic-Base Fibers*

Vendors:

Allied Corporation,
Fibers and Plastics Company,
64 South Miller Road,
Akron, OH 44313,
Production Identification No.: 1W70-1000-192-00
Celanese Fibers,
P. O. Box 32414,
Charlotte, N.C. 28232,
Production Identification No. 1000/192 CLR Type 800

The polyester core yarn is coated according to the following designation and specification and may be obtained from the following sources:

Designation: 25 mil Vinyl Extrusion Coated Polyester Yarn

Specification: No commercial or industry specification presently available

Vendors:

Phifer Wire Products, Inc.,
4400 Kauloosa Avenue,
Tuscaloosa, Ala. 35401,
Product Identification No.: 95—0000250
Engineered Yarns, Inc.,
372 Main Street,
Coventry, R.I. 02816,
Product Identification No.: P25————12

Figure 1:
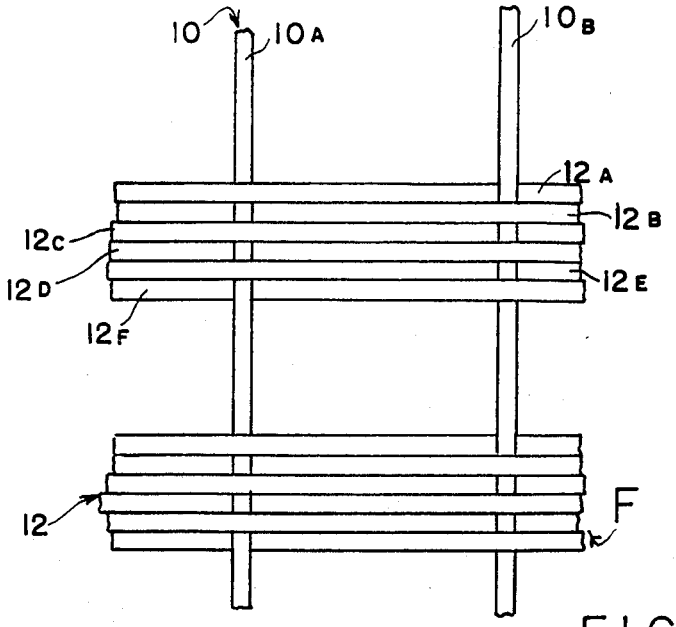
FIG. 1 is an enlarged diagrammatic plan view of the woven screen fabric constructed in accordance with the present invention.

Thus, the coated fiberglass yarn 12 is in the warp direction and constitutes the plurality of closely spaced, over and under individual strands 12*a*, 12*b*, 12*c*, etc. which are woven over and under the individual fill strands 10*a*, 10*b*, etc. that are the coated polyester yarns having, in a preferred embodiment, a 0.025 vinyl coated yarn diameter. It is this combination of yarns which create the unique texture providing the openness of the fabric with good visibility as contrasted with most shade fabrics which are more opaque and do not offer the visibility and openness found in the present fabric. Furthermore, the pleasing texture and design of the present shade fabric is unlike other known shade fabrics, including the Phifer Wire Products, Inc. fabric previously manufactured in accordance with the Hanks Pat. No. 4,002,188 and known as "Sun Screen" (trademark). The present fabric may be woven the same way as that fabric presented in U.S. Pat. No. 4,002,188 in that the strands 12*a* thru 12*f* in the warp direction are arranged in groups which resemble multiple strips that are made of the individual side-by-side small strands 12*a* thru 12*f* interlock with respective fill strands 10*a*, 10*b*, etc. Thus, there are groups of strands 12*a* thru 12*f* which groups, are each designated by reference numeral 12 and arranged in the pattern of alternate strands being over and under and also alternating in the over and under pattern from one fill strand 10*a* to the next 10*b*, etc. For example, referring to FIG. 1, it is seen that strand 12*a* passes over strand 10*a* and then under strand 10*b* whereas the next strand 12*b* passes under strand 10*a* and then over strand 10*b* and so on in sequence in the manner shown in FIG. 2 so that the individual strands 12*a* thru 12*f*, inclusive, alternate over strand 10*a* and in like manner the groups of strands 12 are spaced from one another and alternate in the opposite manner to the group 12 immediately thereabove and therebelow. In a preferred embodiment there are six strands 12*a-f* although it is possible to use other groups.

While I have shown and described a particular embodiment of this invention this is by way of illustration for purposes of disclosure rather than to confine the invention to any specific arrangement as there are various alterations, changes, deviations, eliminations, substitutions, omissions and departures which may be made in the particular embodiment shown and described without departing from the scope of this invention as defined only by a proper interpretation of the appended claims. What is claimed:

1. A woven shade screening fabric comprising a plurality of individual, spaced strands in parallel relationship in one direction of either the warp or fill of a woven fabric and comprising individual strands in substantially uniform pattern, a plurality of groups of strands closely associated in side-by-side relationship in the other direction of the fabric of the warp and fill from that of the preceding described uniform strands, said groups of strands being equally spaced to provide an open weave mesh pattern therebetween for the purposes of admitting some light and air while blocking some of the glare and sunlight, and the strands in each of said groups being arranged with one strand over and the next strand under in alternating interlocking relationship at the point of crossing each of the respective strands in the other direction whereby in each point of intersection some of said strands are over and some of said strands are under and the next successive crossing of groups of strands alternate from the preceding one, each of the next successive strands alternating from over to under at each intersection and then alternating from under to over at the next intersection, the improvement comprising:

the strands in the warp direction being vinyl coated fiberglass yarns comprising a fiberglass core yarn which is coated with a vinyl material, the yarns in the other direction being a vinyl coated polyester yarn comprising polyester core yarn which has been coated with a vinyl composition.

2. The fabric claimed in claim 1 wherein said vinyl coated fiberglass yarn is approximately 0.011 diameter and the vinyl coated polyester yarn is approximately 0.025 diameter.

3. The fabric claimed in claim 2 wherein said mesh is approximately 63×16 construction.

4. The fabric in claim 1 wherein said vinyl coated fiberglass yarn is in accordance with ASTM D 578-81 specification "Standard Specification for Glass Fiber Yarns."

5. The fabric claimed in claim 4 wherein said vinyl coated fiberglass yarn is made in accordance with ASTM D 3374.80 specification "Standard Specification for Vinyl Coated Glass Yarns".

6. The fabric claimed in claim 4 wherein said polyester yarn is in accordance with Specification ASTM D 3219-79 "Standard Tolerances For Industrial Filaments, Tire Cords, and Tire Cord Fabrics Made From Man-Made Organic-Base Fibers".

7. The fabric claimed in claim 1 wherein said polyester yarn is in accordance with Specification ASTM D 3219-79 "Standard Tolerances for Industrial Filament Yarns, Tire Cords, and Tire Cord Fabrics Made from Man-Made Organic-Base Fibers".

8. The fabric in claim 1 wherein said fiberglass yarn being coated with a polyvinyl chloride plastisol coating, said fiberglass yarn being pigmented and heat, light and UV stabilized.

9. The fabric in claim 1 wherein said polyester yarn is coated with a plasticized polyvinyl chloride plastic coating extruded onto the yarn and pigmented, heat, light and UV stabilized.

10. A woven shade screening fabric comprising a plurality of individual, spaced strands in parallel relationship in one direction of either the warp or fill of a woven fabric and comprising individual strands in substantially uniform pattern, a plurality of groups of strands closely associated in side-by-side relationship in the other direction of the fabric of the warp and fill from that of the preceding described uniform strands, said groups of strands being equally spaced to provide an open weave mesh pattern therebetween for the purposes of admitting some light and air while blocking some of the glare and sunlight, and the strands in each of said groups being arranged with one strand over and the next strand under in alternating interlocking relationship at the point of crossing each of the respective strands in the other direction whereby in each point of intersection some of said strands are over and some of said strands are under and the next successive crossing of groups of strands alternate from the preceding one, each of the next successive strands alternating from over to under at each intersection and then alternating from under to over at the next intersection, the improvement comprising:

the strands in the warp direction being vinyl coated fiberglass yarn comprising a fiberglass core yarn which is coated with a vinyl material, said fiberglass yarn being approximately 0.011 diameter and in accordance with ASTM D 3374-80 Specification "Standard Specification for Vinyl Coated Glass Yarns", the yarns in the direction other than warp being a vinyl coated polyester yarn comprising polyester core yarn which has been coated with a vinyl composition, said polyester yarn being approximately 0.025 diameter and in accordance with Specification ASTM D 3219-79 "Standard Tolerances for Industrial Filament Yarns, Tire Cords, and Tire Cord Fabrics Made From Man-Made Organic Base Fibers".

11. The fabric claimed in claim 10 wherein said open weave mesh pattern is approximately $63 \times 16$ construction.

12. The fabric in claim 11 wherein said fiberglass yarn is in accordance with ASTM D 578-81 Specification "Standard Specification for Glass Fiber Yarns".

* * * * *